US012338736B2

(12) United States Patent
Avant

(10) Patent No.: US 12,338,736 B2
(45) Date of Patent: Jun. 24, 2025

(54) ACTUATOR, METHOD, AND SYSTEM

(71) Applicant: Baker Hughes Oilfield Operations LLC, Houston, TX (US)

(72) Inventor: Marcus Avant, Kingwood, TX (US)

(73) Assignee: Baker Hughes Oilfield Operations LLC, Houston, TX (US)

( * ) Notice: Subject to any disclaimer, the term of this patent is extended or adjusted under 35 U.S.C. 154(b) by 0 days.

(21) Appl. No.: 18/496,142

(22) Filed: Oct. 27, 2023

(65) Prior Publication Data

US 2025/0137327 A1 May 1, 2025

(51) Int. Cl.
*E21B 7/06* (2006.01)

(52) U.S. Cl.
CPC ..... *E21B 7/068* (2013.01)

(58) Field of Classification Search
CPC ..... F16J 15/164; E21B 7/068
See application file for complete search history.

(56) References Cited

U.S. PATENT DOCUMENTS

| | | | |
|---|---|---|---|
| 6,494,265 | B2 | 12/2002 | Wilson et al. |
| 9,267,357 | B2 | 2/2016 | Nguyen et al. |
| 2005/0028982 | A1 | 2/2005 | Howlett et al. |
| 2011/0088906 | A1 | 4/2011 | Myerley |
| 2012/0160488 | A1 | 6/2012 | Fould et al. |
| 2015/0027780 | A1 | 1/2015 | Hern et al. |
| 2018/0156011 | A1* | 6/2018 | Eidem ..... E21B 34/12 |
| 2018/0230763 | A1* | 8/2018 | Baudoin ..... E21B 34/101 |

OTHER PUBLICATIONS

Notification of Transmittal of the International Search Report and the Written Opinion of the International Searching Authority, or the Declaration; PCT/US2024/052302; Mail Date: Feb. 4, 2025; 9 pages.

* cited by examiner

*Primary Examiner* — Dany E Akakpo
(74) *Attorney, Agent, or Firm* — Baker Hughes Patent Organization

(57) ABSTRACT

An actuator, including a dynamic component, a static component. A seal is disposed between the dynamic component and the static component. A bypass pathway is open to flow dependent upon a position of the dynamic component relative to the static component, the bypass pathway when open changing a required flow rate to move the dynamic component relative to the static component. A method including applying a first pressure across a seal between a static component and a dynamic component, moving the dynamic component, opening or closing a bypass pathway with the movement, bypassing fluid when open whereby a higher flow rate is required to continue the movement of the dynamic component. A wellbore system, including a borehole in a subsurface formation, a string in the borehole, and an actuator disposed within or as a part of the string.

15 Claims, 10 Drawing Sheets

ACTUATOR, METHOD, AND SYSTEM

BACKGROUND

In the resource recovery and fluid sequestration industries, actuators are ubiquitous and are used for different things in different environments. Having better control over the behavior of actuators would be helpful in the art.

SUMMARY

An embodiment of an actuator, including a dynamic component, a static component disposed adjacent the dynamic component, a seal disposed between the dynamic component and the static component, a bypass pathway disposed in the static component, the bypass pathway being open to flow dependent upon a position of the dynamic component relative to the static component, the bypass pathway when open changing a required flow rate to move the dynamic component relative to the static component.

An embodiment of a method for actuating a tool, including applying a first pressure across a seal between a static component and a dynamic component, moving the dynamic component with the first pressure, opening or closing a bypass pathway pursuant to the movement of the dynamic component, bypassing fluid through the bypass pathway when open whereby a higher flow rate is required to continue the movement of the dynamic component.

An embodiment of a method for controlling a position of a dynamic component relative to a static component of a tool, with which the dynamic component is engaged, including flowing a fluid through the tool to achieve a first pressure differential across the dynamic component, moving the dynamic component with the first pressure differential, varying a rate of the flowing to select a position of the dynamic component relative to the static component based upon position of the dynamic component relative to one or more bypass pathways of the static component.

An embodiment of a wellbore system, including a borehole in a subsurface formation, a string in the borehole, and an actuator disposed within or as a part of the string.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
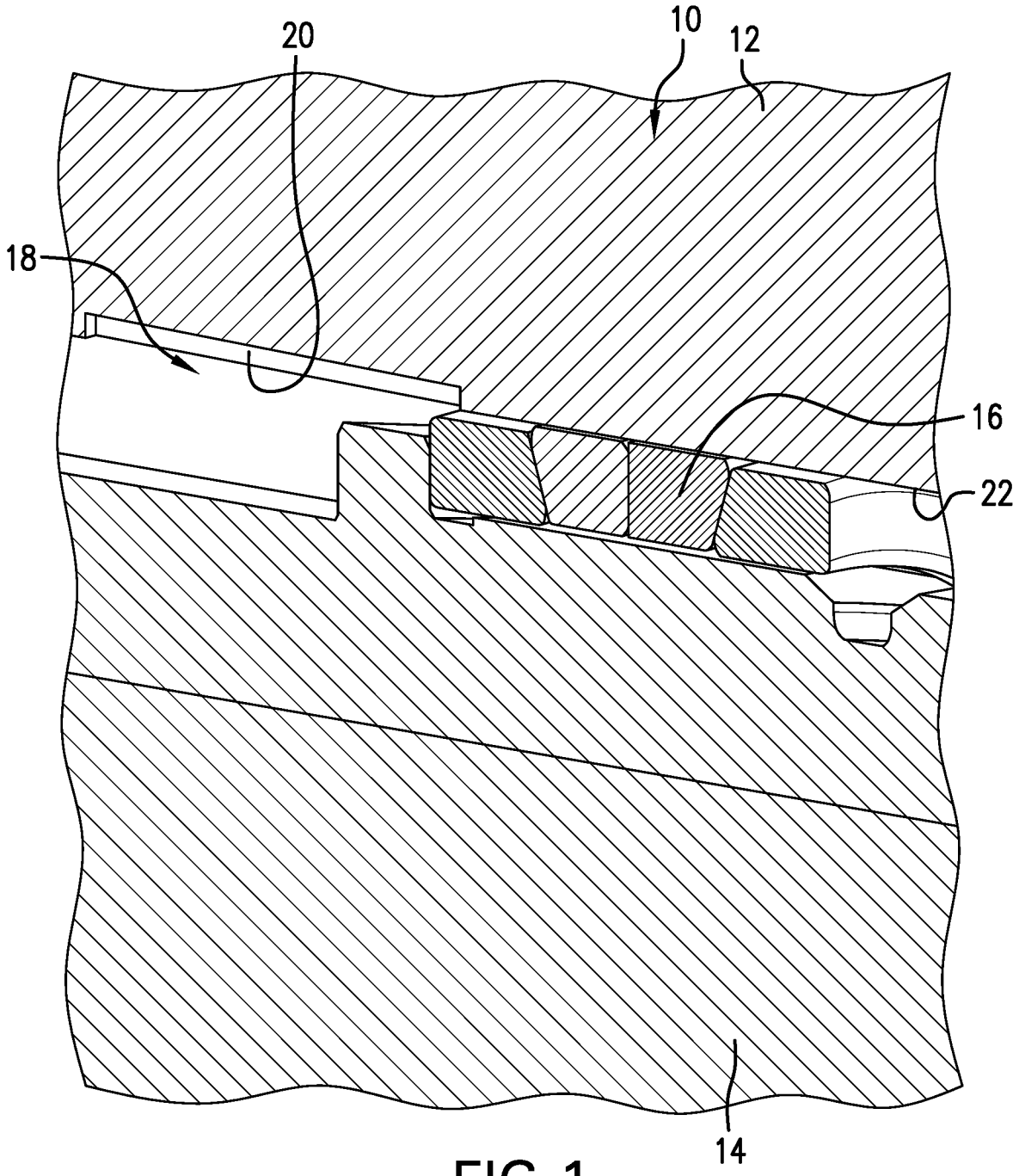
FIG. 1 is a perspective view of an actuator as disclosed herein.

Referring to FIG. 1, an actuator 10 is illustrated. Actuator 10 includes a static component 12 and a dynamic component 14. The dynamic component 14 is movable relative to the static component 12. A seal 16 is disposed between the static component 12 and the dynamic component 14. Pressure applied to the actuator 10 as disclosed will cause the dynamic component 14 to move relative to the static component 12 at a fixed applied pressure similar to prior art devices. As disclosed herein, however, a bypass pathway 18 is disposed in the static component 12. The bypass pathway 18 is configured to provide fluid bypass past seal 16 depending upon the position of the dynamic component 14 relative to the static component 12. In embodiments, movement of the dynamic component 14 in a first direction relative to the static component 12 will occur at about a first pressure differential across seal 16 but when the movement of dynamic component 14 is such that the bypass pathway 18 opens, then fluid will bypass the seal thereby reducing the applied pressure (due to leak off) acting on the seal 16 to drive the dynamic component 14. This will necessitate a higher flow rate to continue moving the dynamic component 14 in the same direction. Conversely, if the dynamic component 14 is moving in the opposite direction the bypass pathway will start open and get closed. When it closes, the applied pressure needed to continue moving the dynamic component 14 would be reduced (or if kept the same, would more rapidly and/or forcefully move the dynamic component 14). Flow rate could accordingly be reduced.

Figure 2:
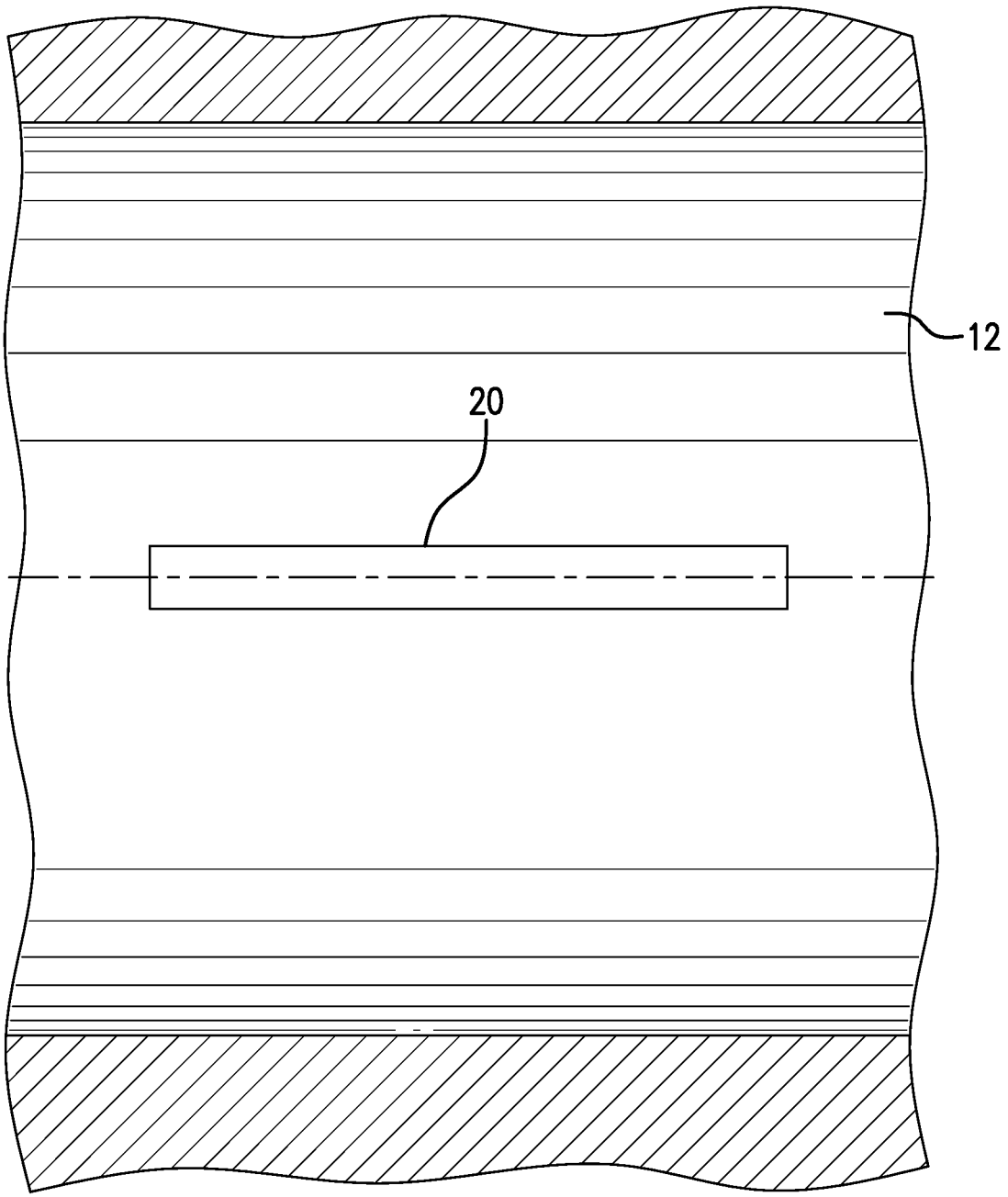
FIG. 2 is a view or a rectangular bypass configuration.
Figure 3:
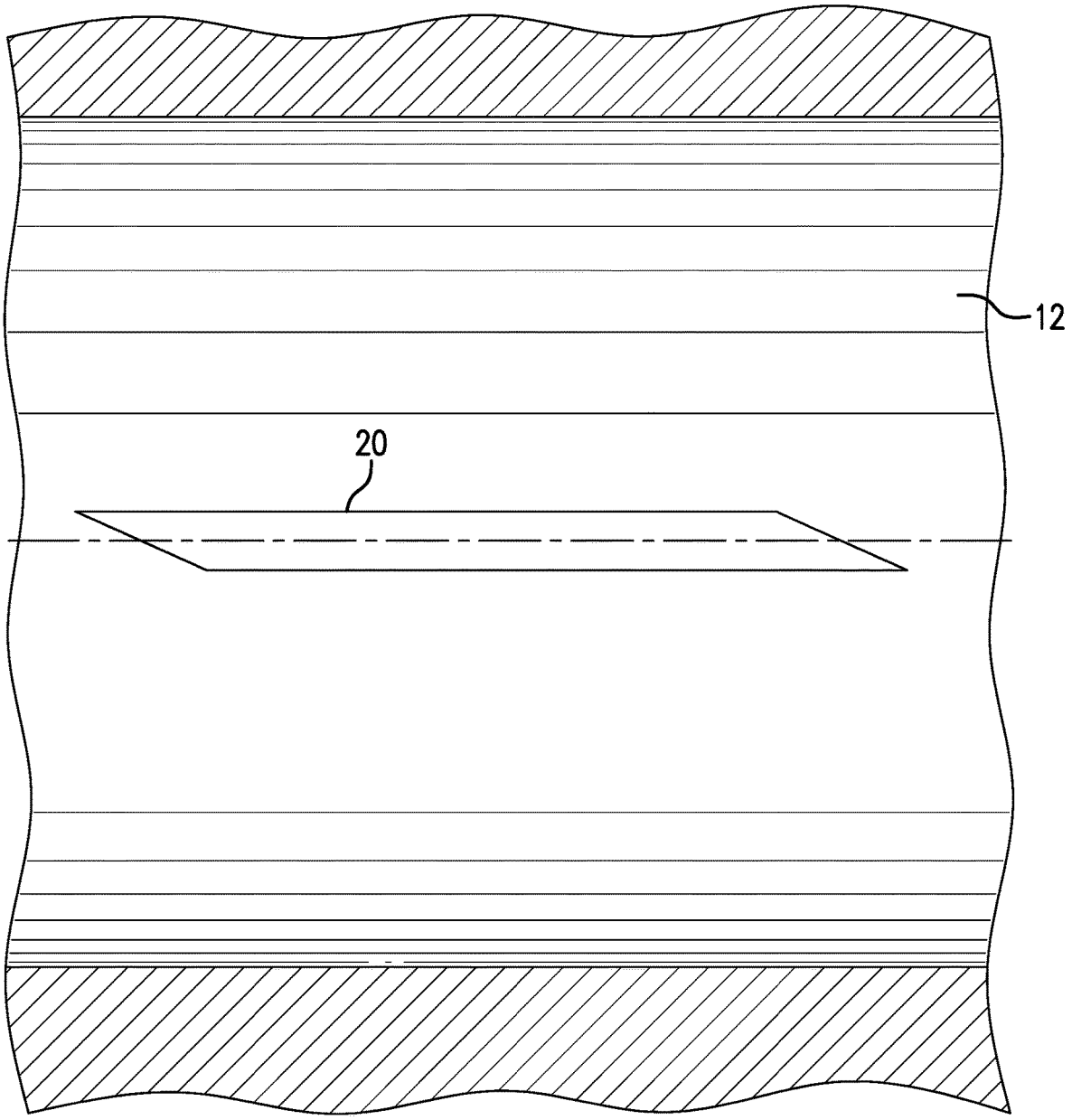
FIG. 3 is a view of a rhomboid bypass configuration.

In embodiments, the bypass pathway 18 may be configured as a recess 20 in an interface wall 22 of the static component 12. The recess 20 provides clearance between the seal 16 and the static component 12 whereby fluid leaks past the seal 16. The dimensions of the recess 20 dictate how much fluid volume will leak past and hence how much of a flow rate increase would be required to maintain movement of the dynamic component 14. The recess 20 may be rectangular in shape (FIGS. 1, 2) (by "shape" it is meant the geometric shape of the opening in the interface wall 22 rather than what the cross-sectional shape might be in depth into the wall 22). A rectangular shaped recess will provide a relatively static bypass volume over the stroke of the dynamic component 14 with adjustment for the enlargement of the actually open portion of the recess as the seal 16 slides farther along the recess 20. One or more of the rectangular shapes (or other geometric shapes) may be disposed about a circumference of the static component 12). Other shapes may be substituted where with relatively fixed volume passage, the sides of the shape that extend longitudinally of the actuator are straight and parallel to a longitudinal axis of the actuator (See FIG. 3).

Figure 4:
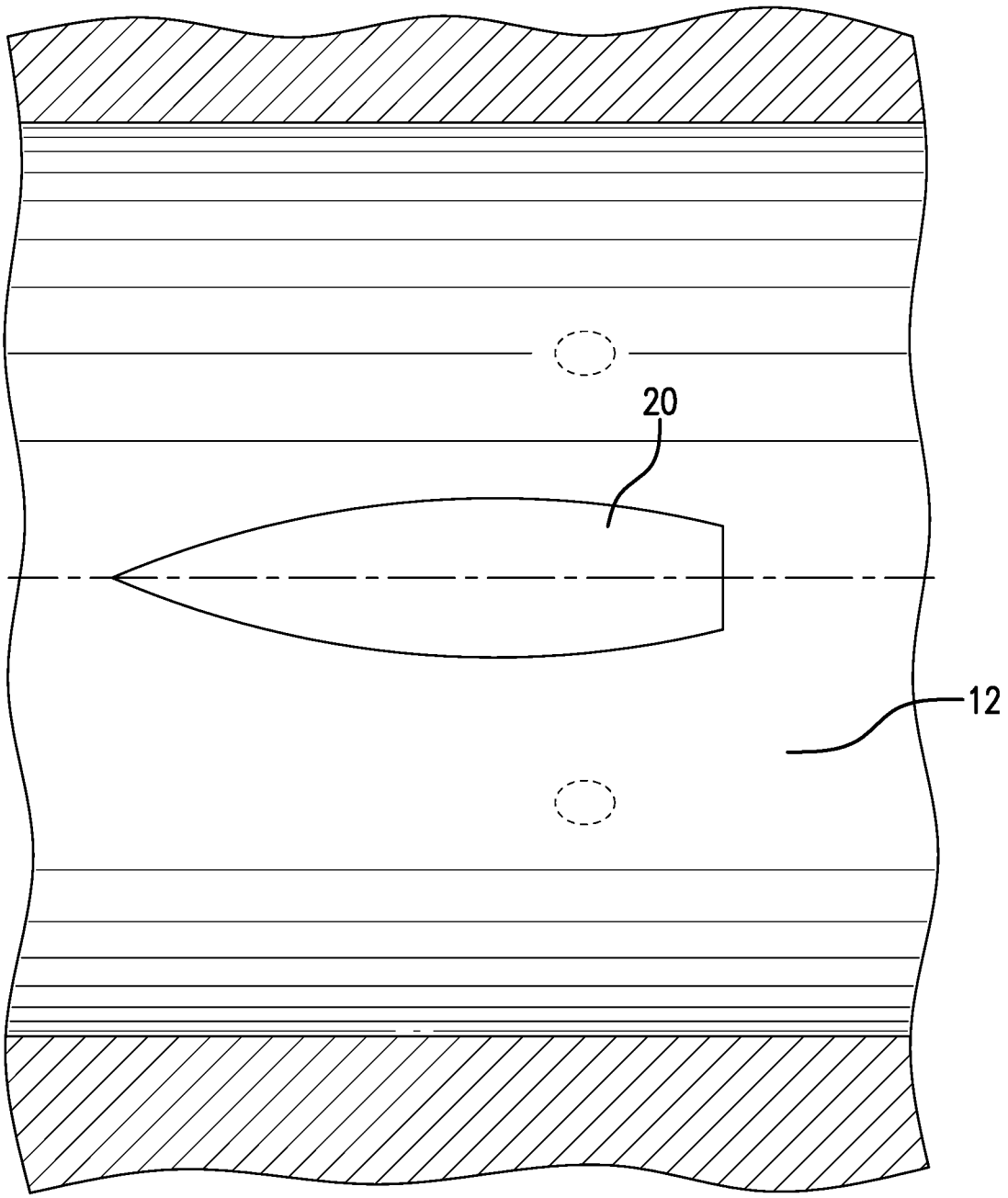
FIG. 4 is a view of a boat shaped bypass configuration.
Figure 5:
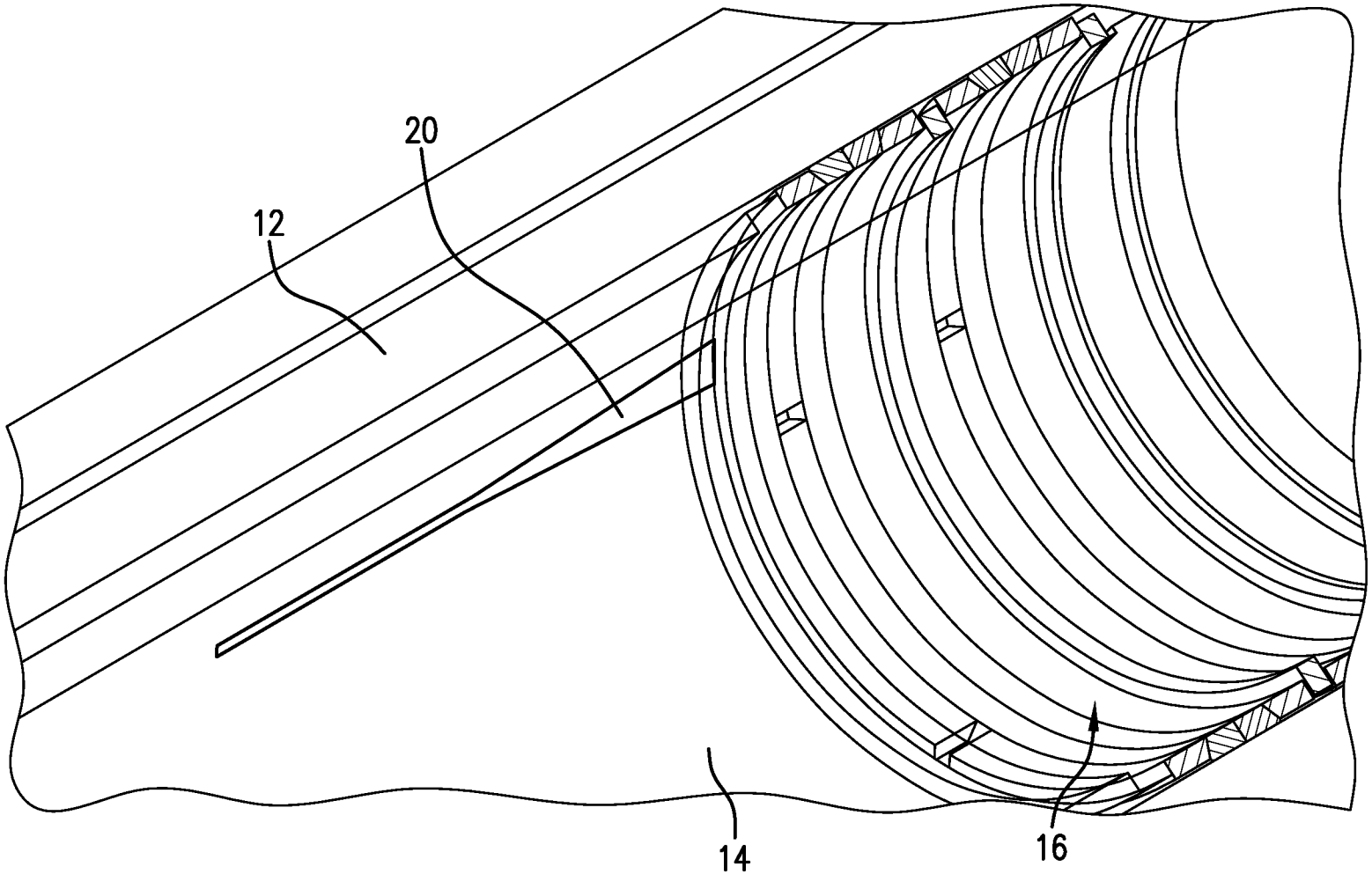
FIG. 5 is a perspective view of a trapezoidal bypass configuration.
Figure 6:
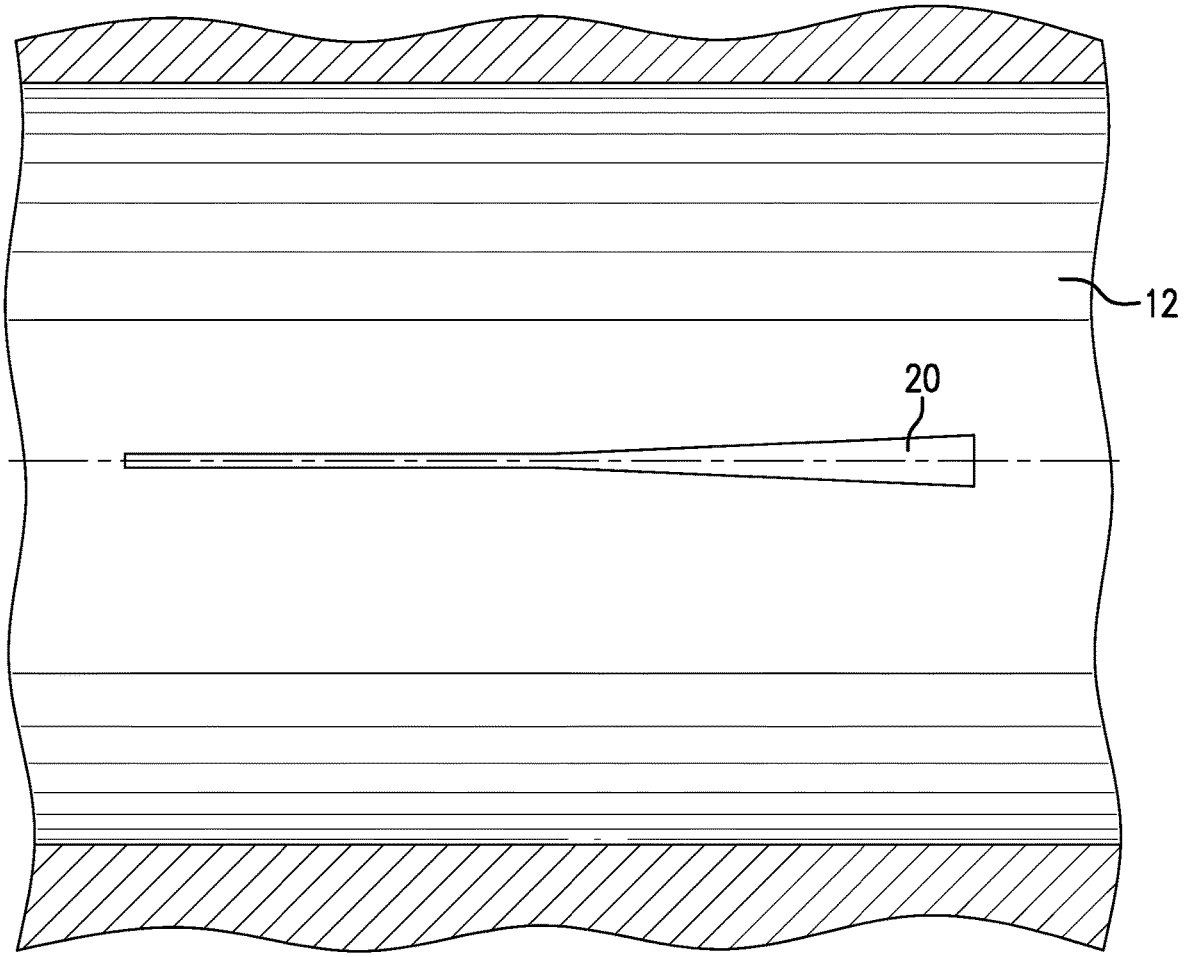
FIG. 6 is another view of the trapezoidal bypass configuration of FIG. 5.

In other embodiments, variable bypass volume is contemplated. To create a variable volume bypass pathway, a number of embodiments are contemplated. In one embodiment, the sides of the shape of the recess 20 that extend longitudinally of the actuator may be straight or non-straight but will be non-parallel to a longitudinal axis of the actuator (See FIGS. 4-6). For example, the recess 20 may be trapezoidally shaped (FIGS. 5 and 6) so that an opening to the recess as the seal 16 slides past, will continuously vary more than simply from the length the opening has acquired. The orientation of the trapezoid, or other shape fitting these criteria, may be manipulated to cause bypass volume to increase or decrease in a particular direction of movement of the dynamic component 14 relative to the static component 12.

Figure 7:
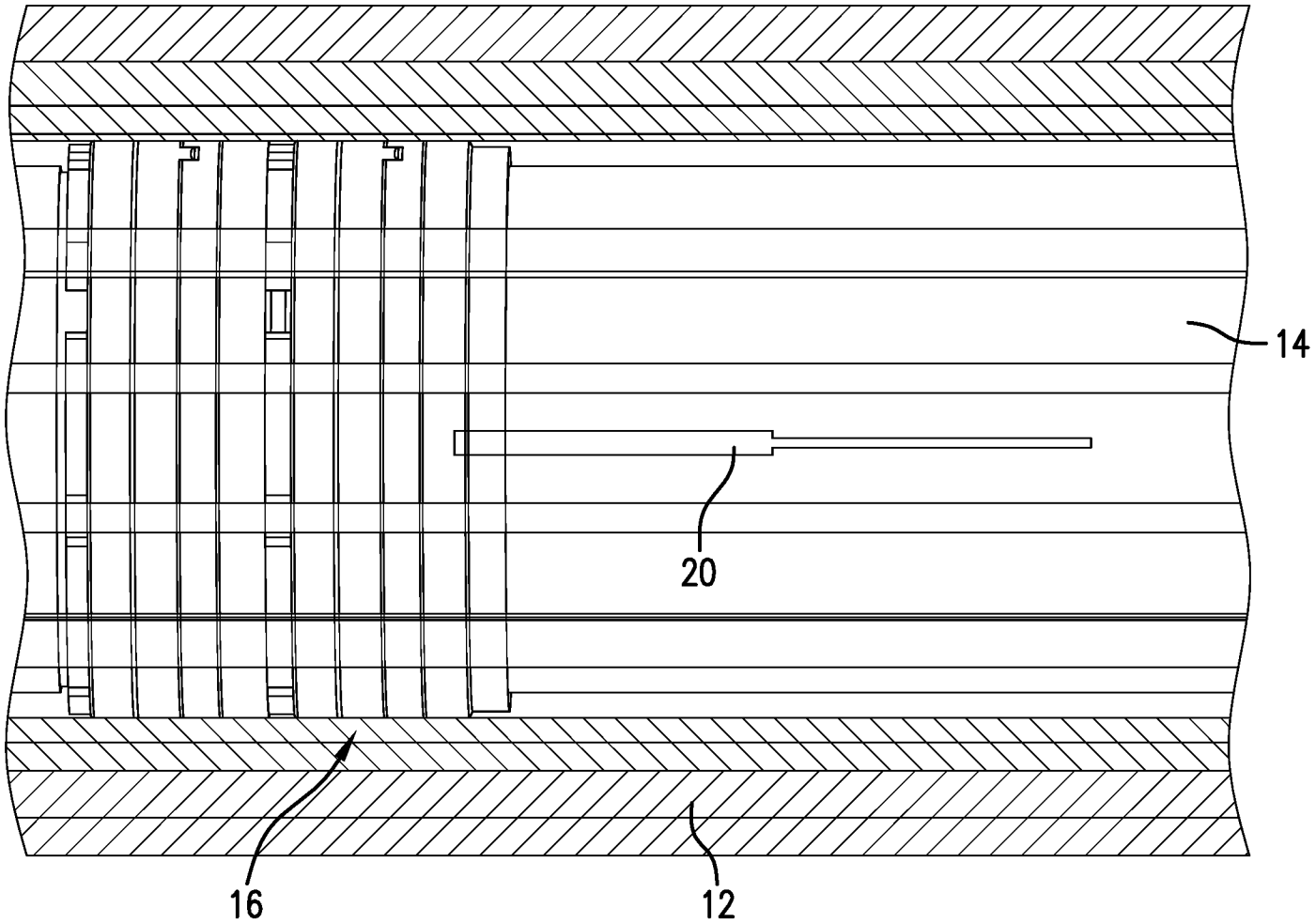
FIG. 7 is a view of a stepped bypass configuration.
Figure 8:
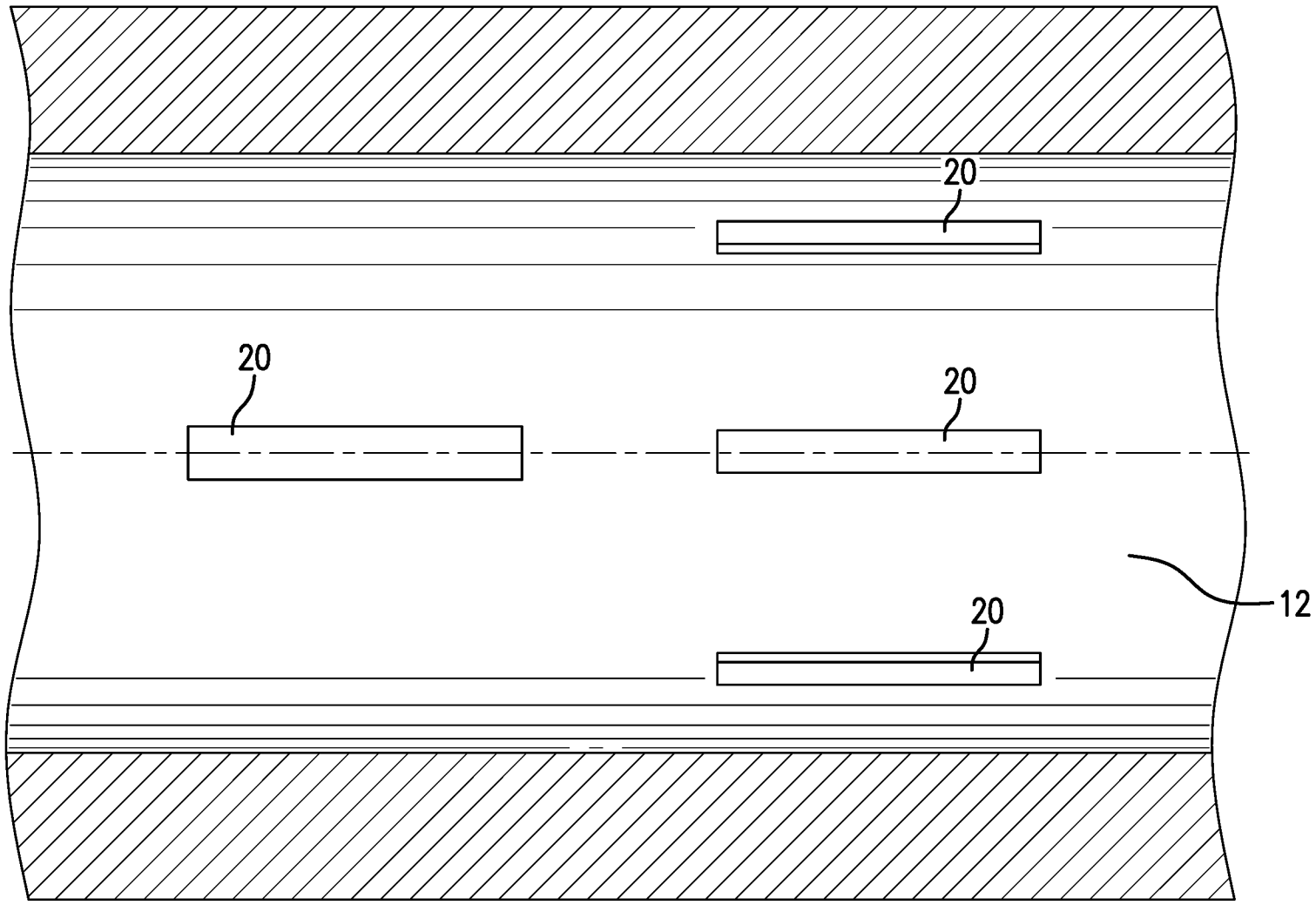
FIG. 8 is a view of another variable bypass configuration employing different banks of bypass recesses.

In another variable bypass volume embodiment, the recess 20 may be added to with another recess that may be connected to the first recess as in FIG. 7 but has a different circumferential dimension, e.g., a stepped configuration. Alternatively, independent recesses as shown in FIG. 8, one or more additional recesses, that are longitudinally staggered in banks of recesses along a longitudinal extent of the component 12. In just one example, FIG. 8 illustrates a first recess in one bank and then three recesses in the next bank adjacent thereto. The number of recesses for either of these two banks may be different, such as the first bank could be two and the next bank could be five, etc. There may be, when considering the system along the axial length thereof, a steady increase or decrease in the number of recesses per bank or there may be an up and down distribution of the number of recesses per bank so that flow rate will need to be raised and lowered for different portions of the actuation with feedback to the operator between the banks of recesses. The number of banks of recesses along the axial length of the static component 12 is limited only by real estate and practicality. In another example, a first recess 20 may be in a first bank of the component 12 and adjacent thereto in the longitudinal direction will be two recesses 20 in a next bank. Then adjacent to the two recesses 20 there might longitudinally be three recesses in a third bank, and so on. As noted above, it is contemplated that the number of recesses will step up by more than one at a time, with the point being that the bypass volume should be selected to cause a noticeable change in the flow rate requirements to keep the component 14 moving. This will facilitate excellent indexing of the dynamic component by requiring a stepwise increase of flow rate to achieve the next position of the dynamic component 14. Returning to the example of FIG. 8, with movement of component 14, this embodiment will start exposing the one recess 20 and then at the end of that recess bypass will momentarily stop until the seal 16 begins exposing the three recess bank and a significantly higher bypass flow begins. In each case a stepped-up volume of fluid will bypass the seal 16, necessitating a stepped up higher flow rate to maintain movement of the component 14. Various geometries are contemplated for this type of variable embodiment as well including non-rectangular shapes such as the trapezoidal type shapes described above, which will provide a variable bypass within each bank of recesses in addition to the stepped variability due to the change in number of recesses 20 in each longitudinal position.

Figure 9:
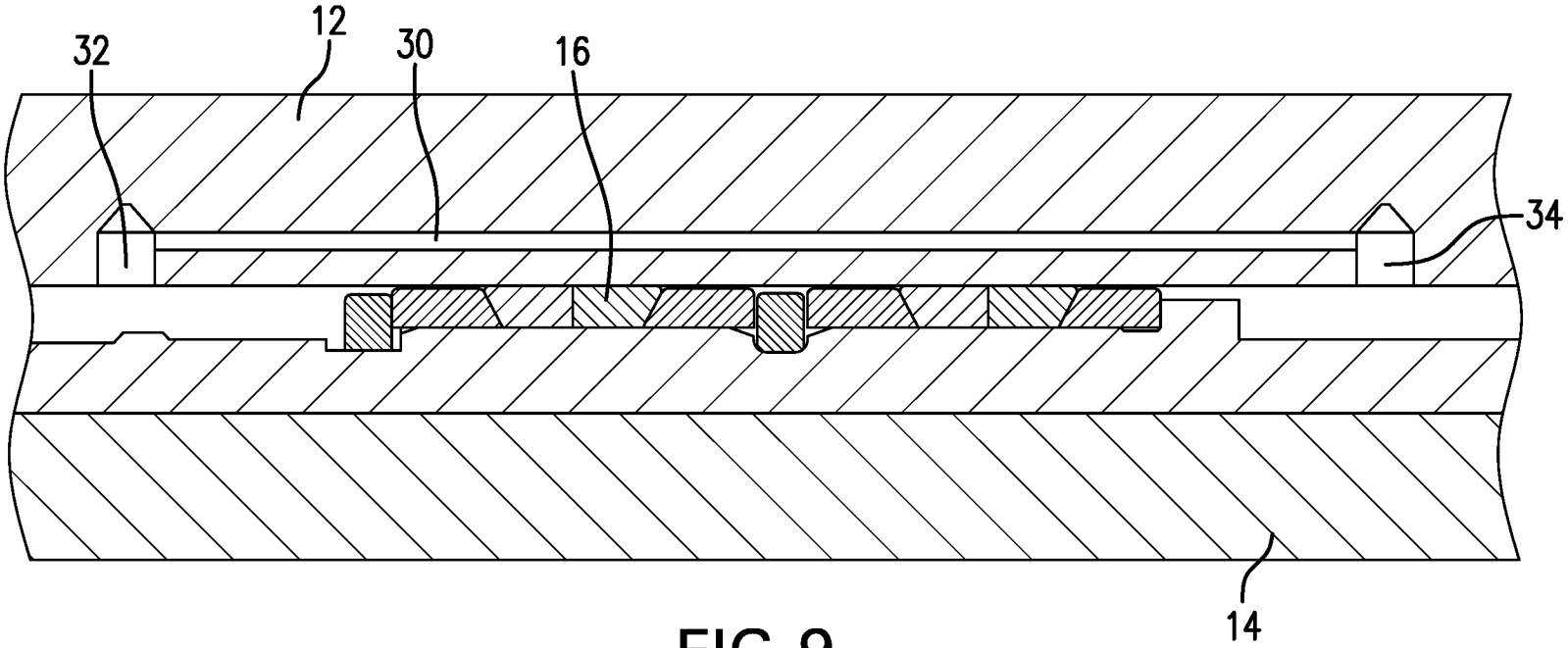
FIG. 9 is a view or an internal to the static component bypass configuration.

In another embodiment, referring to FIG. 9, the recess 20 has been eliminated in favor of a bypass pathway 30 that is internal to the material of the static component 12. Specifically, a conduit is created in the static component 12 that has an inlet 32 and an outlet 34. This embodiment works the same way overall by allowing pressure to bleed off through pathway 30 once the inlet 32 is exposed to the pressure source side of the seal 16. This embodiment could also be combined with recess embodiments for particular desired applications.

Figure 10:
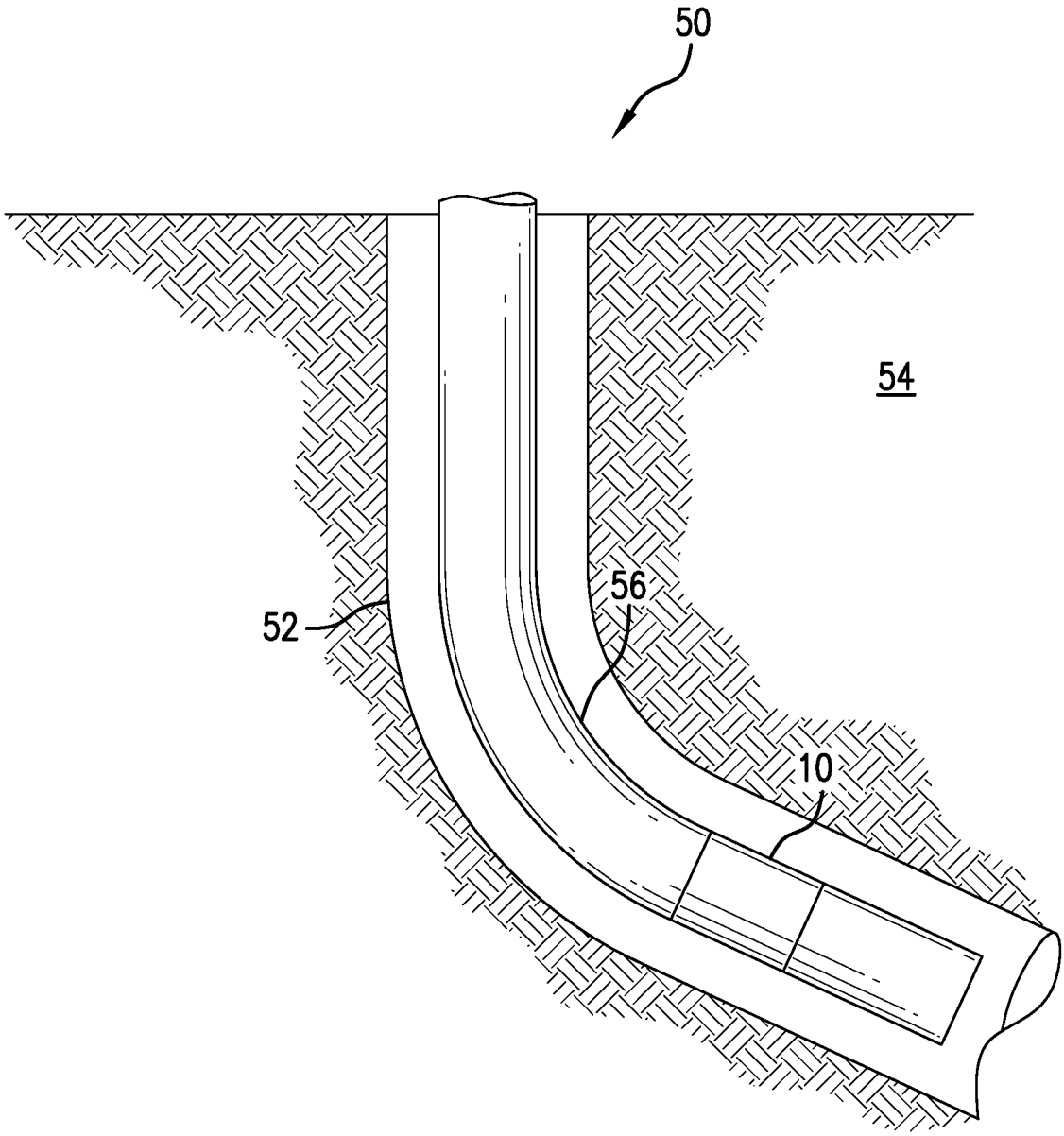
FIG. 10 is a view of a borehole system including the actuator as disclosed herein.

Referring to FIG. 10, a borehole system 50 is illustrated. The system 50 comprises a borehole 52 in a subsurface formation 54. A string 56 is disposed within the borehole 52. An actuator 10 as disclosed herein is disposed within or as a part of the string 56.

Set forth below are some embodiments of the foregoing disclosure:

Embodiment 1: An actuator, including a dynamic component, a static component disposed adjacent the dynamic component, a seal disposed between the dynamic component and the static component, a bypass pathway disposed in the static component, the bypass pathway being open to flow dependent upon a position of the dynamic component relative to the static component, the bypass pathway when open changing a required flow rate to move the dynamic component relative to the static component.

Embodiment 2: The actuator as in any prior embodiment, wherein the pathway is of fixed volume bypass.

Embodiment 3: The actuator as in any prior embodiment, wherein the bypass pathway passes a variable volume of fluid depending upon position of the dynamic component relative to the static component.

Embodiment 4: The actuator as in any prior embodiment, wherein the variable volume of fluid is a stepwise change.

Embodiment 5: The actuator as in any prior embodiment, wherein the variable volume of fluid is a gradual change.

Embodiment 6: The actuator as in any prior embodiment, wherein the volume increases with dynamic component stroke in one direction and decreases with dynamic component stroke in an opposite direction.

Embodiment 7: The actuator as in any prior embodiment, wherein the variable volume bypass pathway is a recess in a surface of the static component that interfaces with the seal.

Embodiment 8: The actuator as in any prior embodiment, wherein the recess is rectangular in shape.

Embodiment 9: The actuator as in any prior embodiment, wherein the recess is other than rectangular in shape.

Embodiment 10: The actuator as in any prior embodiment, wherein the recess is trapezoidal in shape.

Embodiment 11: The actuator as in any prior embodiment, wherein the recess changes in depth along a longitudinal axis of the actuator.

Embodiment 12: The actuator as in any prior embodiment, wherein the variable volume bypass pathway is a plurality of pathways, the number of pathways changing as the dynamic component moves relative to the static component.

Embodiment 13: The actuator as in any prior embodiment, wherein the bypass pathway is enclosed within the static component and includes an inlet and an outlet.

Embodiment 14: A method for actuating a tool, including applying a first pressure across a seal between a static component and a dynamic component, moving the dynamic component with the first pressure, opening or closing a bypass pathway pursuant to the movement of the dynamic component, bypassing fluid through the bypass pathway when open whereby a higher flow rate is required to continue the movement of the dynamic component.

Embodiment 15: The method as in any prior embodiment, wherein a volume of bypassing fluid changes with continued movement of the dynamic component.

Embodiment 16: The method as in any prior embodiment, wherein the volume of bypassing fluid increases with dynamic component movement in a first direction relative to the static component and decreases with dynamic component movement in a second direction relative to the static component.

Embodiment 17: A method for controlling a position of a dynamic component relative to a static component of a tool, with which the dynamic component is engaged, including flowing a fluid through the tool to achieve a first pressure differential across the dynamic component, moving the dynamic component with the first pressure differential, varying a rate of the flowing to select a position of the dynamic component relative to the static component based upon position of the dynamic component relative to one or more bypass pathways of the static component.

Embodiment 18: A wellbore system, including a borehole in a subsurface formation, a string in the borehole, and an actuator as in any prior embodiment disposed within or as a part of the string.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The terms "about", "substantially" and "generally" are intended to include the degree of error associated with measurement of the particular quantity based upon the equipment available at the time of filing the application. For example, "about" and/or "substantially" and/or "generally" can include a range of +8% of a given value.

The teachings of the present disclosure may be used in a variety of well operations. These operations may involve using one or more treatment agents to treat a formation, the fluids resident in a formation, a borehole, and/or equipment in the borehole, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. An actuator, comprising:

a dynamic component;

a static component disposed adjacent the dynamic component;

a seal disposed between the dynamic component and the static component;

a bypass pathway disposed in the static component, the bypass pathway being open to flow dependent upon a position of the dynamic component relative to the static component, the bypass pathway when open changing a required flow rate to move the dynamic component relative to the static component, wherein the bypass pathway passes a variable volume of fluid depending upon position of the dynamic component relative to the static component, the variable volume bypass pathway being a recess in a surface of the static component that interfaces with the seal.

2. The actuator as claimed in claim 1, wherein the variable volume of fluid is a stepwise change.

3. The actuator as claimed in claim 1, wherein the variable volume of fluid is a gradual change.

4. The actuator as claimed in claim 1, wherein the volume increases with dynamic component stroke in one direction and decreases with dynamic component stroke in an opposite direction.

5. The actuator as claimed in claim 1, wherein the recess is rectangular in shape.

6. The actuator as claimed in claim 1, wherein the recess is other than rectangular in shape.

7. The actuator as claimed in claim 1, wherein the recess is trapezoidal in shape.

8. The actuator as claimed in claim 1, wherein the recess changes in depth along a longitudinal axis of the actuator.

9. The actuator as claimed in claim 1, wherein the variable volume bypass pathway is a plurality of pathways, the number of pathways changing as the dynamic component moves relative to the static component.

10. The actuator as claimed in claim 1, wherein the bypass pathway is enclosed within the static component and includes an inlet and an outlet.

11. A method for actuating a tool, comprising:

applying a first pressure across a seal between a static component and a dynamic component in the actuator as claimed in claim 1;

moving the dynamic component with the first pressure;

opening or closing a bypass pathway pursuant to the movement of the dynamic component;

bypassing fluid through the bypass pathway when open whereby a higher flow rate is required to continue the movement of the dynamic component.

12. The method as claimed in claim 11, wherein a volume of bypassing fluid changes with continued movement of the dynamic component.

13. The method as claimed in claim 12, wherein the volume of bypassing fluid increases with dynamic component movement in a first direction relative to the static component and decreases with dynamic component movement in a second direction relative to the static component.

14. A method for controlling a position of the dynamic component relative to the static component in the actuator as claimed in claim 1, comprising:

flowing a fluid through the actuator to achieve a first pressure differential across the dynamic component;

moving the dynamic component with the first pressure differential;

varying a rate of the flowing to select a position of the dynamic component relative to the static component based upon position of the dynamic component relative to one or more bypass pathways of the static component.

15. A wellbore system, comprising:

a borehole in a subsurface formation;

a string in the borehole; and an actuator as claimed in claim 1 disposed within or as a part of the string.

* * * * *